United States Patent [19]

Sack et al.

[11] Patent Number: 4,952,486

[45] Date of Patent: Aug. 28, 1990

[54] SUPPORT MATERIAL FOR THERMALLY DEVELOPABLE PHOTOGRAPHIC LAYERS

[75] Inventors: Wieland Sack, Bissendorf; Reiner Anthonsen, Bramsche, both of Fed. Rep. of Germany

[73] Assignee: Felix Schoeller, Jr. GmbH & Co., KG, Osnabrück, Fed. Rep. of Germany

[21] Appl. No.: 420,616

[22] Filed: Oct. 10, 1989

Related U.S. Application Data

[63] Continuation of Ser. No. 183,397, Apr. 13, 1988, abandoned, which is a continuation of Ser. No. 862,048, May 12, 1986, abandoned.

[30] Foreign Application Priority Data

May 21, 1985 [DE] Fed. Rep. of Germany ..... 3518113

[51] Int. Cl.[5] ..... G03C 1/87

[52] U.S. Cl. ..... 430/532; 430/203; 430/538; 430/618; 430/619

[58] Field of Search ..... 430/538, 532, 617, 619, 430/203, 618

[56] References Cited

U.S. PATENT DOCUMENTS

| | | | |
|---|---|---|---|
| 3,582,337 | 6/1971 | Griggs et al. | 430/532 |
| 3,667,959 | 6/1972 | Bojara et al. | 430/203 |
| 4,311,774 | 1/1982 | Raphael | 430/532 |
| 4,352,861 | 10/1982 | von Meer et al. | 430/538 |
| 4,364,971 | 12/1982 | Sack et al. | 427/44 |
| 4,384,040 | 5/1983 | von Meer | 430/532 |
| 4,584,267 | 4/1986 | Masukawa et al. | 430/203 |
| 4,594,315 | 6/1986 | Shibue et al. | 430/532 |
| 4,610,957 | 9/1986 | Kato et al. | 430/203 |
| 4,665,013 | 5/1987 | Sack et al. | 430/532 |

FOREIGN PATENT DOCUMENTS

| | | |
|---|---|---|
| 0119830 | 9/1984 | European Pat. Off. . |
| 0123166 | 10/1984 | European Pat. Off. . |

OTHER PUBLICATIONS

*Neblette's Handbook of Photography and Reprography*, Sturge, editor, seventh edition, 1977, pp. 32, 33 and 570.

Jacobsen et al, "Imaging Systems", Focal Press Limited, 1976, pp. 122–125.

*Primary Examiner*—Richard L. Schilling

*Attorney, Agent, or Firm*—Lockwood, Alex, Fitzgibbon & Cummings

[57] ABSTRACT

An image-bearing paper is provided which contains a bonding agent that is reticulated by ionizing rays, or bears a coating on at least one surface that contains a bonding agent reticulated by ionizing rays, whereby the bonding agent is predominantly formed of unsaturated substances, and reticulation takes place by means of ionizing rays in or on the paper, which is used as a support material for thermally developable photographic layers, or as an image-receiving material for thermally developed images produced by diffusion of the image-forming substance.

8 Claims, No Drawings

SUPPORT MATERIAL FOR THERMALLY DEVELOPABLE PHOTOGRAPHIC LAYERS

This application is a continuation of application Ser. No. 183,397 filed Apr. 13, 1988 now abandoned which is a continuation of application Ser. No. 862,048 filed May 12, 1986 now abandoned.

BACKGROUND OF THE INVENTION

The invention generally relates to a support material for thermally developable photographic layers. It particularly concerns the use of a coated paper as a carrier for such photographic layers.

Photographic materials which can be developed by the influence of heat are already known. Such materials have been described, for example, in "Imaging Systems", by K. I. Jacobsen and R. E. Jacobsen, page 122 ff (Focal Press, London, 1976), as well as in Neblette's "Handbook of Photography and Reprography", 7th Edition, 1978, pages 32, 33, and 570 (Van Nostrand Reinhold Company). They are furthermore currently commercially available and are referred to as so-called "dry-silver" materials.

Among the most important components of thermally developable photographic layers are at least one organic metallic salt compound and at least one reduction agent. This principle applies for both thermally developable black-and-white image layers, as well as thermally developable color image layers. Furthermore, silver halogenides, anti-fogging agents, sensitizers, color formers, activators, catalysts and/or other additives for the improvement of the image quality or image stability can be contained in one or several of the image layers or in adjacent layers.

Bonding agents for a thermally developable photographic layer can be either a water-insoluble plastic, such as, for example, polyvinylbutyral, or a water-soluble binder, such as, for example, gelatin or polyvinylalcohol, and the photographic layer is applied and dried to a carrier as a coatable preparation, in accordance with generally known coating processes.

Suitable organic metallic compound components of thermally developable photographic systems can include organic silver salts, which are preferred, for example, silver laurate, silver stearate, silver behenate, silver urazol, silver triazol, silver benzotriazol, silver tetrazol, silver carbazol, silver imidazol, and the like. Other organic metallic compounds can be suitable, such as mercury salts, ferric salts and tellurium salts of these types of organic groups. Long chain or fatty acid silver salts are generally preferred. The type of oxidation-effecting metal compounds can vary provided the result is that a visible photographic image is obtained in the exposed material after heat treatment, and without the use of hydrous process solutions which use is generally already known. Heat treatment procedures according to the present invention include having the material coated for imaging brought to a temperature between about 80 and about 250° C., preferably between about 100 and about 200° C.

Various different papers and synthetic film materials typically are suitable for use as carrier materials for thermally developable photographic layers. For example, according to European Patent No. 118,078 and European Patent No. 119,830, (incorporated by reference hereinto), polyester film is a preferred synthetic film support material. Other suitable carrier materials include papers that typically are coated with a resin of the type used for wet development systems, for example resins such as polyethylene.

Synthetic film material supports are particularly well suited when transparency of the carrier material is desired. They have, however, disadvantages if the support material needs to be reflective. The remission level of 85 to 90% that is specified, for example, in European Patent No. 119,830 as being generally normal for white synthetic film material is not always sufficient for attaining optimal image sharpnesses. Generally, synthetic film materials are, moreover, relatively inflexible and expensive.

On the other hand, the known resin-coated papers, such as, for example, polyethylene-coated papers, do, of course, possess all of the good properties of paper, but have, however, only limited possibilities for use, since the thermoplastic polyolefin resin coating layer softens even at relatively slightly raised temperatures. Under development temperatures of 100° C. or more, the resin layer of such coated papers deforms, and, under development by means of hot rollers, a separation between the photographic layer and the resin layer has been observed.

Furthermore, thermally developable photographic materials, in which a color image arises which, during or after the thermal development, is transferred to an image-receiving material by diffusion transfer, have recently become known. Processes and materials in this regard are, for example, described in European Patents No. 76,492, No. 79.056, No. 119,470, No. 118,078, No. 121,765, No. 123,166, No. 125,521, No. 131,161, as well as in DOS 3,345,023, DOS 3,407,228 and DOS 3,422,455. Even with this technology, it appears that conventional resin-coated papers, because of the thermoplasticity of their resin layers, are less suitable than image-receiving materials.

It is thus an object of the present invention to provide a carrier material that is of improved suitability for thermally developable photographic layers and an image-receiving material that is especially well suited for thermally developed color photographic images. In particular, it is an object of the invention to select a material which, through its heat stability, has good application properties, and furthermore, does not influence the thermally developable photographic layers in an undesirable manner.

These objectives are solved by providing and using a particular type of paper as support material for thermally developable photographic layers or as image-receiving material for thermally developed color images, which paper contains a reticulated bonding agent, or at least a reticulated layer on its surface. The reticulated component of the paper is produced from ray-hardenable materials, whereby the reticulatable original material consists mainly of unsaturated monomer, oligomer, or polymer substances, and is reticulated in or on the paper by means of ionizing radiation. Unsaturated substances as used herein refers to substances with at least one carbon-to-carbon double bond (C=C), such as, for example, acrylate or methacrylate compounds.

The use of such types of coated papers for normal photographic layers which contain silver halogenide, and which are to be developed wet, is described in U.S. Pat. No. 4,384,040, incorporated by reference hereinto. It has proven that the layers of radiation-hardenable material, hardened by ionizing radiation (for example, electron beams), with the exclusion of air, produces fogging in adjacent silver halogenide layers, when the coated papers are of the type that can be developed wet. The polymerization inhibitor or conversion product normally contained in the hardenable material has been discussed as a possible cause of this fogging formation, since substances used as inhibitors, for example, hydroquinone, can also be used as photographic developers. Reductively acting substances of this type are numerous, as well as components of the thermally developable photographic layers which are co-responsible for image production. Consequently, considerable attention has been given to the use of layers hardened with ionizing radiation, directly as a substrate for photographic layers to be developed thermally, or as receiving material for thermally developed color images as well, because the unsaturated compounds used for producing the layers which are hardened by radiation are always stabilized in their commercial forms by adding polymerization inhibitors.

Surprisingly, the use of the layers produced as inhibitor-containing unsaturated compounds, which were hardened by ionizing radiation, have not led, however, to the feared disadvantageous effects of thermally developable photographic layers. Rather, such types of impregnated or coated papers proved to be well suited, and carriers which can be used in versatile ways showed no secondary effects on thermally developed photographic layers, and they were also well suited as image-receiving materials for thermally developed color photographic images.

Papers which are coated with radiation-hardened bonding agents can, on the one hand, be translucent or transparent. In this form, they are preferably used for thermally developable black-and-white layers to be considered for optically clear visibility, and are used, for example, in producing weather charts. Through the addition of white pigments, they can, on the other hand, be reflective, and mainly find use in this form for visual images.

With non-pigmented, radiation-hardenable mixtures, coated or impregnated papers for transparent images show, after hardening, a more even transparency than preparations containing, for the sake of comparison, solvents, coated papers, or impregnated and dried papers.

With pigmented radiation-hardened mixtures, coated papers contain, above all else, the possible high pigmentation level of the coating. Thus, coatings with 30 to 60 weight percent of white pigment (for example, titanium oxide) can be produced. After hardening by means of ionizing radiation, luminance factors of up to 95% were measured on such layers, so that the production of particularly sharp and brilliant images was made possible.

A further advantage important for use in accordance with the invention is that impregnations and coatings of radiation-hardenable mixtures, after the hardening is carried out by means of ionizing radiation, can be very temperature-resistant. The layers do not deform even during short-term application of high temperatures of 200° C. or more, and the coated or impregnated papers are, with smaller changes in their moisture content, more dimensionally stable than the papers previously used. Finally, such papers can, during the use of a contact hardening process, in accordance with U.S. Pat. No. 4,364,971, incorporated by reference hereinto, have a surface quality thoroughly comparable to foils, in connection with the flexibility of a coated paper.

All base papers suited for photographic uses are suited for the production of support materials used in accordance with the invention, which papers can, in the known manner, be treated with radiation-hardenable mixtures already known in principle, and can be coated after hardening by means of ionizing radiation (for example, electron beams or other energetic radiation), either directly, or after use of known adhesion-mediating intermediate steps, such as corona treatment or an adhesive layer with one or several photographic layers for thermal development, as well as, if necessary, of protective layers and/or, if necessary, an anti-halo protective layer or further auxilliary layers. The thermally developable photographic layers may belong to the group of the black-and-white layers or the group of color image layers. In the following examples, there are described a number of uses, without these examples being restrictive for the invention.

EXAMPLE 1

A photographic base paper weighing approximately 70 g/m$^2$ which was impregnated with approximately 12 g/m$^2$ of a mixture of:

30 weight percent of polyestertetraacrylate (having an average molecular weight of approximately 1000);
30 weight percent of triethyleneglycol diacrylate;
20 weight percent of polyethyleneglycol (400) diacrylate;
10 weight percent of pentaerythritol triacrylate; and
10 weight percent of hydroxyethyl acrylate.

The impregnation took place in a protective gas atmosphere, was applied to one side, was hardened by means of electron beams with an energy dose of 40 Joules/gram, was subjected on one side to a corona treatment, and was subsequently coated with a thermally developable photographic layer containing silver behenate, in accordance with DE OS 27 28 627, as well as a protective layer of vinylchloride/vinylacetate copolymer. The opposite side received an anti-halo protective coating corresponding to the composition specified in example 4 of the European Patent No. 119,830, as follows:

| | |
|---|---|
| 2,2'-azobisisobutyronitrile | 7.0 g |
| 3-(4'-chlorophenyl)sydnone | 1.0 g |
| diphenyliodonium hexafluorophosphate | 1.0 g |
| acetone | 20.0 ml |
| toluene | 30.0 ml |
| polystyrene MW 100,000 solution (50% in toluene) | 60.0 g |
| ethyl cellulose (10% in toluene) | 20.0 g |
| Dye No. 4 solution (0.4 in acetone) | 5.0 ml |
| Dye No. 5 solution (0.4% in acetone) | 5.0 ml |

EXAMPLE 2

Photographic base paper weighing approximately 70 g/m$^2$ with a surface sizing of carboxylated polyvinylalcohol, is coated on one side with approximately 20 g/m$^2$ of a mixture, as follows:

40.0 weight percent of surface-modified $TiO_2$-Rutil;
0.5 weight percent of ultramarine violet;
0.1 weight percent of optical brightener Uvitex OB;
20.0 weight percent of trimethylolpropantriethoxitriacrylate;
12.5 weight percent of pentaerythritoltriacrylate;
11.5 weight percent of hydroxyethylacrylate;
10.0 weight percent of triethylenglycoldiacrylate;

5.4 weight percent of polyestertetraacrylate (average molecular weight of approximately 1000).

Such is hardened under protective gas by means of electron rays with an energy dose of 40 Joules/gram and is, after the corona treatment of the surface, coated on one side with the normal thermally developable photographic layer on the base of silver behenate, as well as a protective layer lying above the same.

EXAMPLE 3

A photographic base paper weighing about 130 g/m$^2$, with a preliminary coating of essentially polyvinylalcohol and barium sulfate, is coated on one side with approximately 25 g/m$^2$ of a mixture hardened under protective gas by means of electron rays with an energy dose of 35 Joules/gram, the mixture being:

35.0 weight percent of surface-modified $TiO_2$;

0.5 weight percent of ultramarine violet;

25.0 weight percent of triacrylate of oxypropylated glycerine (molecular weight of 480);

20.0 weight percent of polyester tetraacrylate (average molecular weight of about 1000);

19.5 weight percent of hexanediol diacrylate.

After corona treatment, same is coated with approximately 2 g/m$^2$ of a 1:1 mixture of gelatin and trimethyl vinylbenzyl ammonium chloride copolymer, and is used as an image-receiving material for a thermally developable photographic color image in accordance with DOS 33 45 023. Through this, the image-receiving material is brought into contact with the exposed layer of the photographic material and transferred to the image-receiving material by diffusion transfer of the coloring substances.

EXAMPLE 4

A paper, reflectively coated in accordance with Example 2, is used as a support material for a thermally developable layer and an anti-halo protective layer in accordance with European Patent No. 119,830.

What we claim is:

1. A method for making a thermally developable paper photographic support, comprising:

providing a paper support material suitable for use in photographic systems;

treating said paper support material with an electron beam hardenable bonding agent composition that contains a compound having carbon-to-carbon unsaturated bonds and a polymerization inhibitor;

subjecting the paper support material having said bonding agent composition to ionizing election beam radiation in order to thereby harden said bonding agent and provide a carrier having a hardened bonding agent coating; and coating a thermally developable photographic layer over said hardened bonding agent coating, and said thermally developable photographic layer is a thermographic dry system including an organic silver salt and an organic reduction agent;

whereby the thermally developable paper photographic support made by this method is resistant to fogging by the polymerization inhibitor of the electron beam hardenable bonding agent composition.

2. The method according to claim 1, further including using the diffusion transfer process in order to provide image-receiving thermally developable color photographic recording material, said diffusion transfer process including coating the paper support material with heat developable silver halide layers and dye image-forming compounds.

3. The method according to claim 1, wherein said treating and subjecting steps form a layer of hardened bonding agent on said paper support material.

4. The method according to claim 1, wherein said treating and subjecting steps provide hardened bonding agent within said paper support material.

5. The method according to claim 1, wherein said unsaturated compound is selected from the group consisting of an acrylate and a methacrylate.

6. The method according to claim 1, wherein said organic silver salt of the thermally developable photographic layer is a thermographic dry organic silver salt.

7. The method according to claim 1, wherein said thermally developable photographic layer is laid down from a thermally developable photographic coating composition including a silver salt of a long chain organic acid as said organic silver salt.

8. A method for making and developing a thermally developable paper photographic support, comprising:

providing a paper support material suitable for use in photographic systems;

treating said paper support material with an electron beam hardenable bonding agent composition that contains a compound having carbon-to-carbon unsaturated bonds and a polymerization inhibitor in sufficient quantity to prevent polymerization of the unsaturated compound during storage;

subjecting the paper support material having said bonding agent composition to ionizing electron beam radiation in order to thereby harden said bonding agent and provide a carrier having a hardened bonding agent coating;

coating a thermally developable photographic layer over said hardened bonding agent coating to form a coated paper photographic support, and said thermally developable photographic layer is a thermographic dry system including an organic silver salt and an organic reduction agent; and thermally developing said coated paper photographic support in the absence of fogging of the electron beam hardenable bonding agent composition.

* * * * *

UNITED STATES PATENT AND TRADEMARK OFFICE

CERTIFICATE OF CORRECTION

PATENT NO. : 4,952,486

DATED : August 28, 1990

INVENTOR(S) : Sack et al.

It is certified that error appears in the above-identified patent and that said Letters Patent is hereby corrected as shown below:

Col. 5, line 50, "election" should read --electron--.

Signed and Sealed this

Twenty-fourth Day of August, 1993

Bruce Lehman

*Attest:*

BRUCE LEHMAN

*Attesting Officer*

*Commissioner of Patents and Trademarks*